US007353674B2

(12) United States Patent
Raatikainen et al.

(10) Patent No.: US 7,353,674 B2
(45) Date of Patent: Apr. 8, 2008

(54) DOOR LOCK WITH CONTROLLABLE HANDLE OPERATION

(75) Inventors: Juha Raatikainen, Joensuu (FI); Petri Tirkkonen, Hammaslahti (FI)

(73) Assignee: Abloy Oy, Joensuu (FI)

( * ) Notice: Subject to any disclaimer, the term of this patent is extended or adjusted under 35 U.S.C. 154(b) by 0 days.

(21) Appl. No.: 10/595,499

(22) PCT Filed: Oct. 5, 2004

(86) PCT No.: PCT/FI2004/000582

§ 371 (c)(1),
(2), (4) Date: Apr. 24, 2006

(87) PCT Pub. No.: WO2005/042886

PCT Pub. Date: May 12, 2005

(65) Prior Publication Data

US 2007/0051143 A1 Mar. 8, 2007

(30) Foreign Application Priority Data

Oct. 30, 2003 (FI) ..... 20031579

(51) Int. Cl.
*E05B 47/00* (2006.01)
*E05B 59/00* (2006.01)

(52) U.S. Cl. ..... 70/277; 70/107; 70/283

(58) Field of Classification Search ..... 70/107, 70/124, 277, 279.1–283; 292/143, 140, 161, 292/137, 173, 169
See application file for complete search history.

(56) References Cited

U.S. PATENT DOCUMENTS 6,145,353 A * 11/2000 Doucet ..... 70/277
2004/0089040 A1* 5/2004 Raatikainen ..... 70/283

FOREIGN PATENT DOCUMENTS

EP 0537531 4/1993

(Continued)

*Primary Examiner*—Patricia Engle
*Assistant Examiner*—Alyson Merlino
(74) *Attorney, Agent, or Firm*—Smith-Hill and Bedell

(57) ABSTRACT

A door lock with controllable handle operation including a bolt (3), a follower (5) for moving the bolt and an operation axis (4), on both ends of which an actuator can be installed for operating the follower (5), whereby force transmission from either side of the lock to the follower (5) is established by means of movable coupling members (10*a*, 10*b*), which are controlled by a solenoid arrangement (8, 9) or the like, and in which the follower (5) is provided with two separate torsion units (6*a*, 6*b*) installed on the operation axis (4) on different sides of the follower (5) and turnably secured thereto, which units can be connected to force transmission with the follower (5) by utilising said coupling members (10*a*, 10*b*). The door lock comprises a selecting member (7) movable from one lock side to the other, which member retains the torsion unit (6*a*, 6*b*) selected in each case to be unturnable with respect to the follower (5), so that force transmission from the operation axis (4) to the follower (5) is connected on that particular side of the lock, and on the other side of the lock, force transmission from the operation axis (4) to the follower (5) can be selectively either connected or disconnected by means of said coupling members (10*a*, 10*b*) under the control of the solenoid arrangement (8, 9).

12 Claims, 9 Drawing Sheets

FOREIGN PATENT DOCUMENTS

Figure 1:
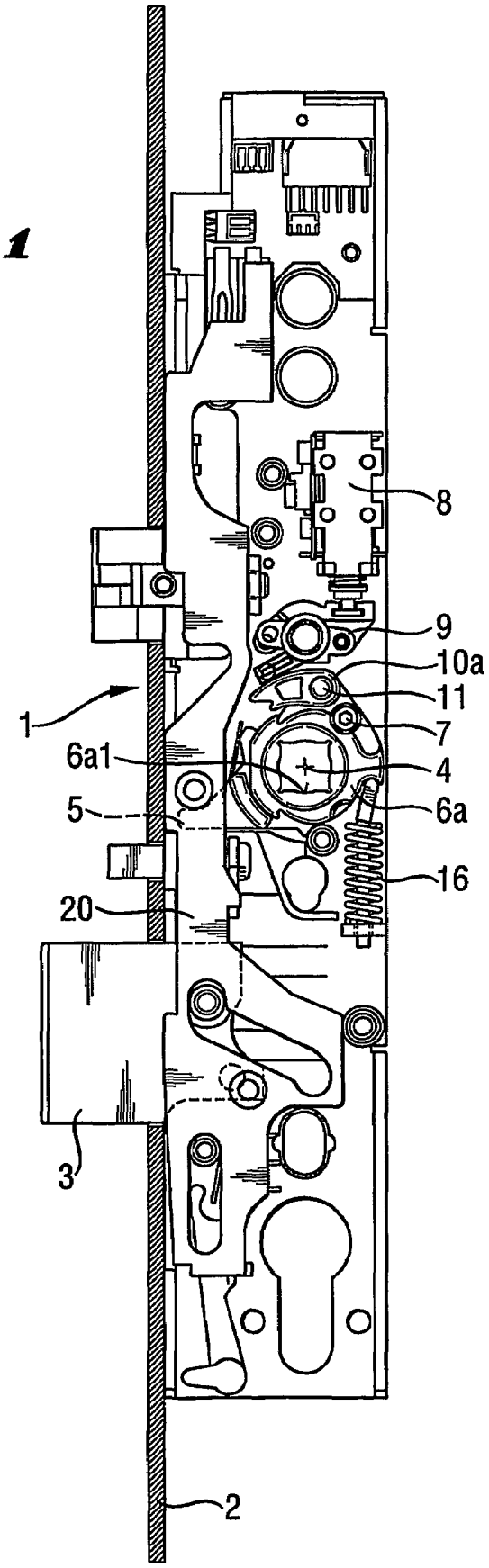

| | | | |
|---|---|---|---|
| EP | 537531 | A1 * | 4/1993 |
| EP | 0620341 | | 10/1994 |
| EP | 620341 | A1 * | 10/1994 |
| EP | 1291478 | | 3/2003 |
| EP | 1291478 | A1 * | 3/2003 |
| WO | 02059440 | | 8/2002 |
| WO | WO 02059440 | A1 * | 8/2002 |

* cited by examiner

DOOR LOCK WITH CONTROLLABLE HANDLE OPERATION

This is a national stage application filed under 35 USC 371 based on International Application No. PCT/FI2004/000582 filed Oct. 5, 2004, and claims priority under 35 USC 119 of Finnish Patent Application No. 20031579 filed Oct. 30, 2003.

The invention relates to a door look with controllable handle operation.

The control of a handle operation in a door lock by means of a solenoid arrangement or the like can be accomplished in different ways depending on the application. The arrangement may for instance be such that, when the solenoid is energized, it permits or enables access by using a handle, whereby force transmission from the handle to the bolt of the lock is connected. Alternatively, the solution may be reversed so that the arrangement allows access by using a handle, when the solenoid is de-energized. The choice of the operational mode of the arrangement depends on whether the safety of access, i.e. the safety of exit, or the security of the locked space is emphasized.

In practice, the arrangement is normally such that the door can always be opened from outside by a key-operated lock mechanism or the like and from inside by a handle, turning knob or the like, whereby the selective coupling of the handle operation requires at the same time a two-piece, i.e. divided, drive shaft. Depending on the location of application the arrangement can also be for instance such that the door is provided with a handle or the like on both sides, whereby the door can always be opened from one side by a handle and from the other side only selectively depending on the situation.

When installing a door lock of the above kind, a choice has to be made deciding for instance on which side of the door, and thereby on which side of the lock casing of the door lock, the selective handle operation needs to be arranged so that the same lock casing may be used for doors turnable in different directions. In the solution disclosed in the patent publication EP 1354112 a separate adapting member installed on the operation axis of the actuators of the lock is employed, whereby it prevents direct operation of the follower by the actuator on the selected side of the lock. In this case, force transmission is effected from the operation axis to the follower by means of a torsion unit under the control of a solenoid utilising a latch as a coupling member. On the other side of the lock force transmission is continuously connected.

The patent publication EP 537531 discloses a solution, by means of which constant force transmission from the operation axis to the follower can be established and transferred from one side of the lock to the other. In this solution, a separate selecting member that is movable from one side of the lock to the other side and interlocks the latch with the torsion unit on the selected side, is utilised, whereby force transmission is provided from the operation axis via the torsion unit and said latch to the follower. In this arrangement, constant force transmission is thus always established via the latch and on the other hand, no force transmission can be provided from the other side of the lock, whereby the arrangement does not include any kind of solenoid-based selection procedure either.

An object of the invention is to provide a novel solution, which offers a wide range of possibilities for installing and utilising the door lock so that the lock can always be used from one side of the door and the use from the other side is selectively controlled. According to the solution, the lock casing should, when installed in the door, be convertible so that it can be used in the door independently of the direction in which the door is to be turned. A further aim is that the changes made in the lock casing can, by means of the installation arrangement, be realized as simply and easily as possible without opening the lock casing. The solution should also have a simple and reliable structure.

According to the invention, the door lock comprises a selecting member movable from one lock side to the other, which member retains the torsion unit (6*a*, 6*b*) selected in each case to be unturnable with respect to the follower (5), so that force transmission from the operation axis (4) to the follower (5) is connected on that particular side of the lock, and on the other side of the lock the force transmission from the operation axis to the follower can be selectively either connected or disconnected by means of said coupling members under the control of a solenoid arrangement. The arrangement does not require a separate adapting member to be installed on the operation axis. Thus, the torsion units and their spindle openings can be designed so that it is not at all possible to turn the follower directly from the operation axis, which tends to contribute to the security of the arrangement. On the other hand, since the selection is not made through the latch acting as a coupling member and the force transmission on the lock side exposed to continuous force transmission is not established via the latch, the strength requirements for the latch, consequently, are minor.

In practise, the selecting member is preferably a screw or the like movable in the direction of the operation axis. The follower is provided with a threaded opening for the selecting member. Thus, the selecting member can be installed into its place firmly, which secures the connection between the torsion unit and the follower.

According to one preferable embodiment of the invention the torsion units are provided with a recess or the like, which is shaped so as to receive at least a part of the selecting member. Thereby the selecting member can preferably be provided with an extended head, which cooperates with said recess or the like, when the selecting member is installed thereto.

From the viewpoint of force transmission an advantageous application is accomplished when the follower is provided with a guiding member extending to said recess or the like of the torsion unit in the direction of the mid-axis of the opening in the follower and being in cooperation with the selecting member. In addition, said guiding member may also be provided with a guiding surface, which is arranged to cooperate with the protrusion at the torsion unit, while the follower is being turned.

According to one alternative embodiment of the invention said opening of the follower is arranged in a protrusion and each of the torsion units is provided with a corresponding protrusion, respectively, in which an opening is arranged for the selecting member, whereby the openings can be arranged concentrically with respect to the opening in the follower for installing the selecting member.

Figure 2:
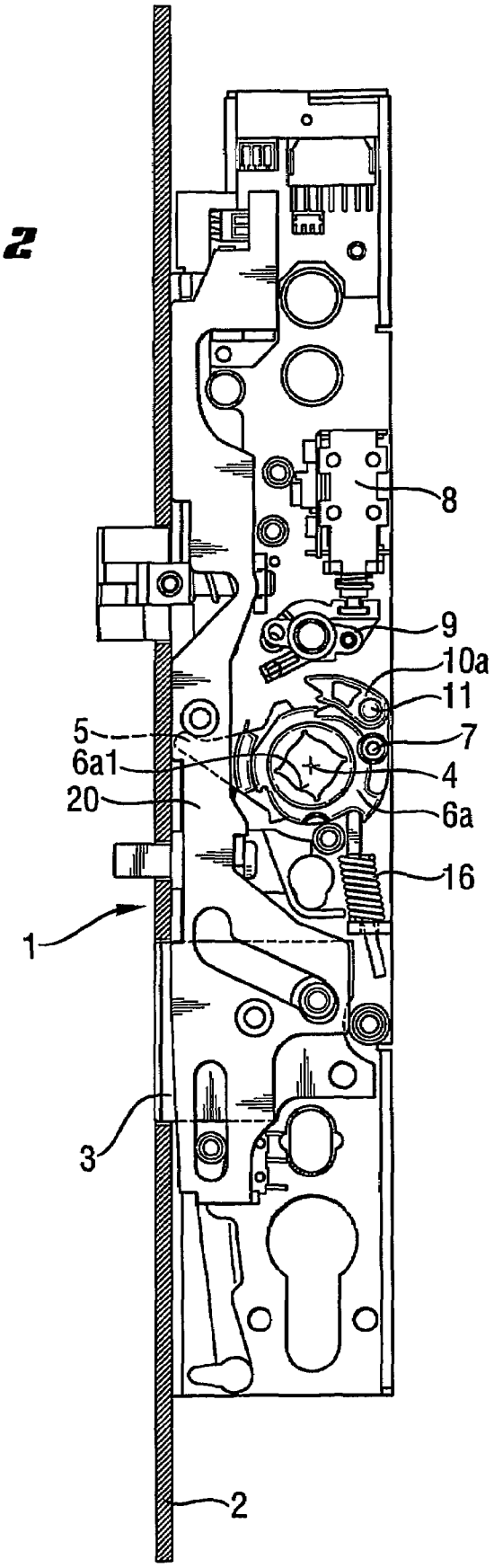
Figure 3:
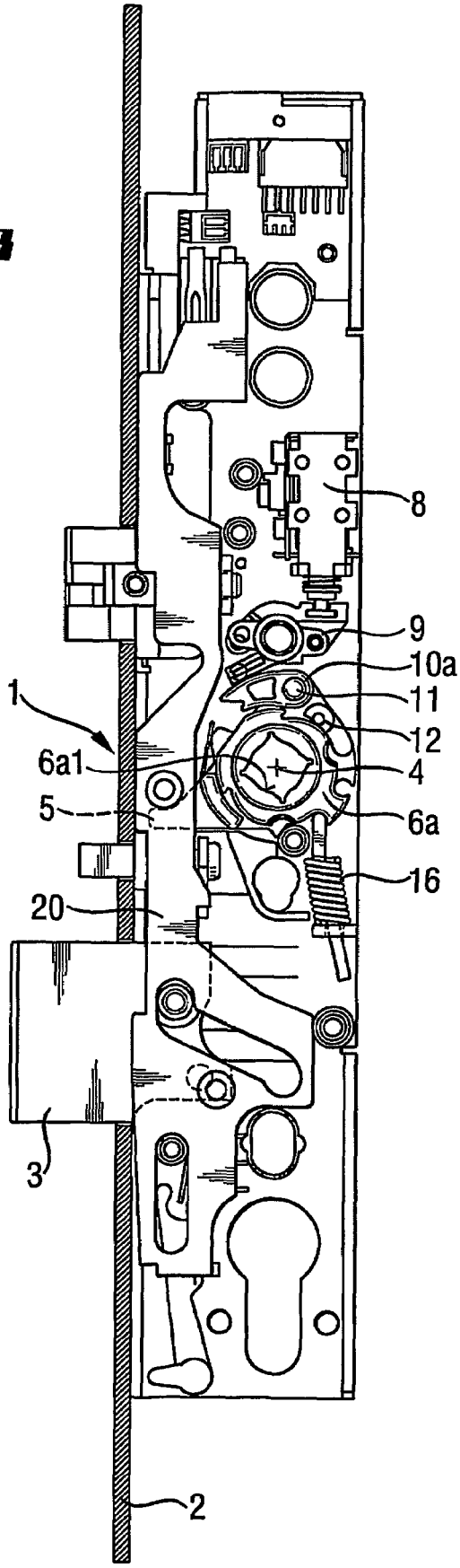
Figure 4:
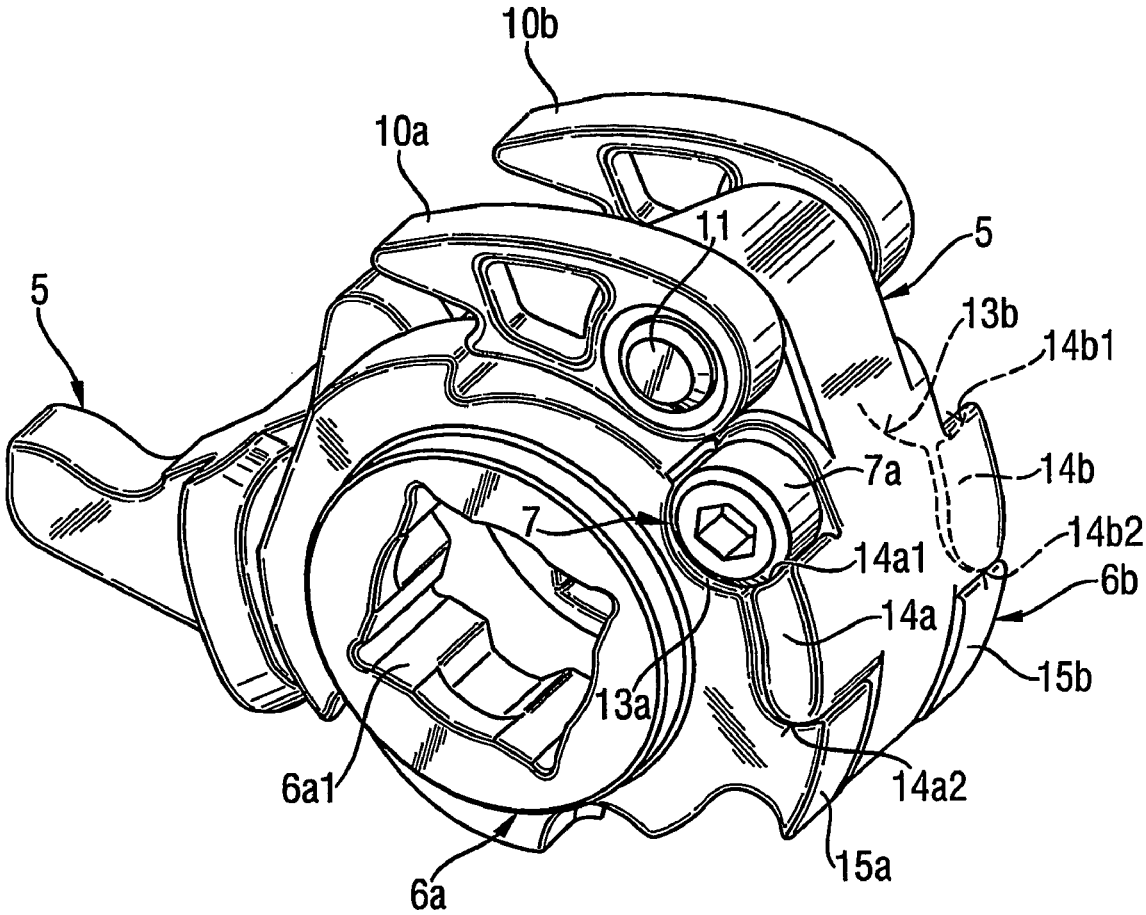
Figure 5:
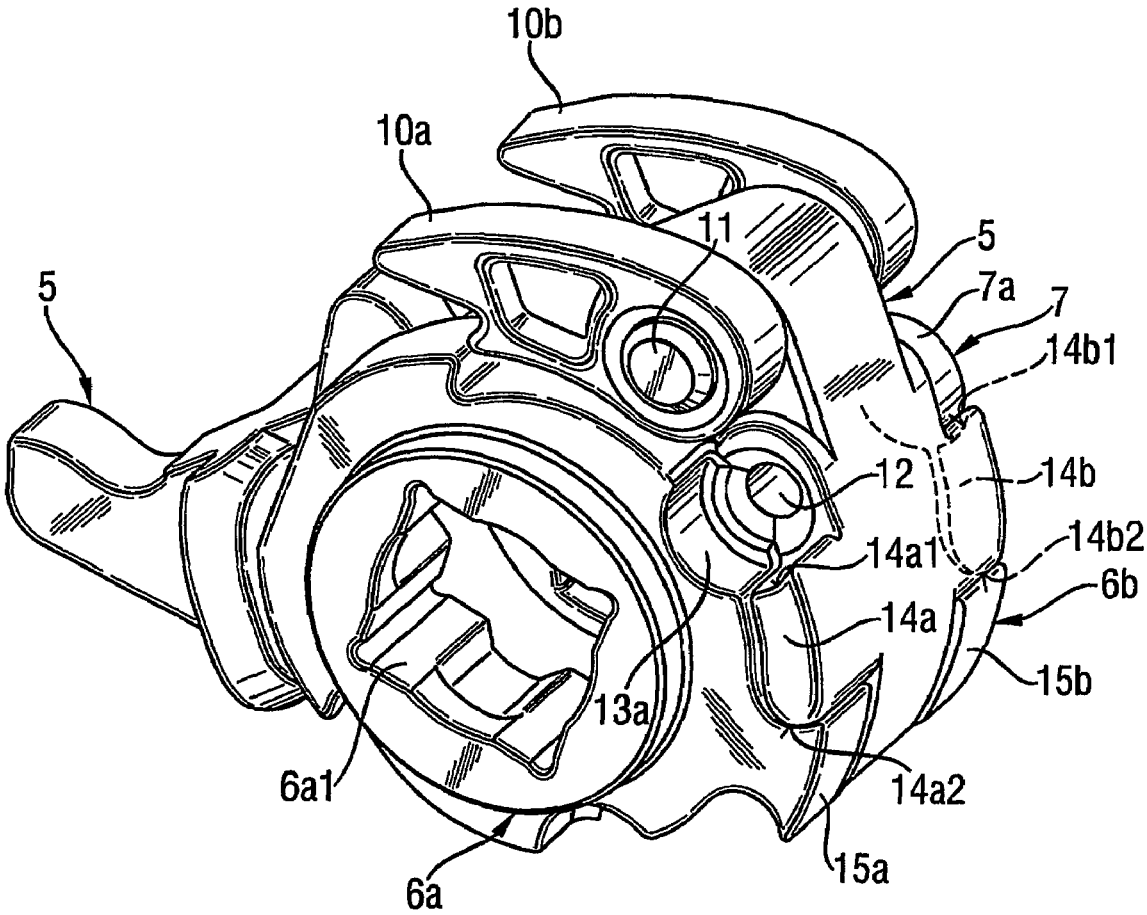
Figure 6:
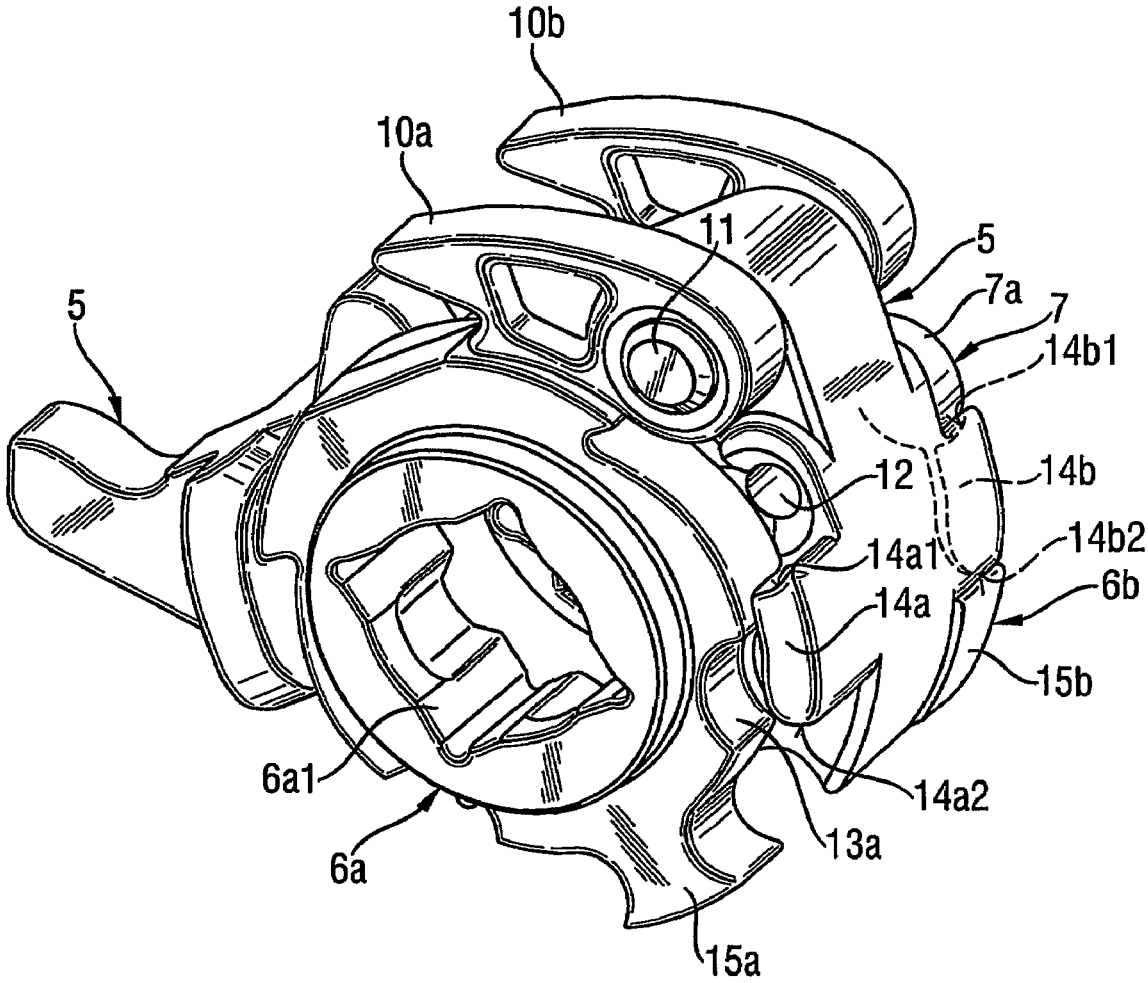
Figure 7:
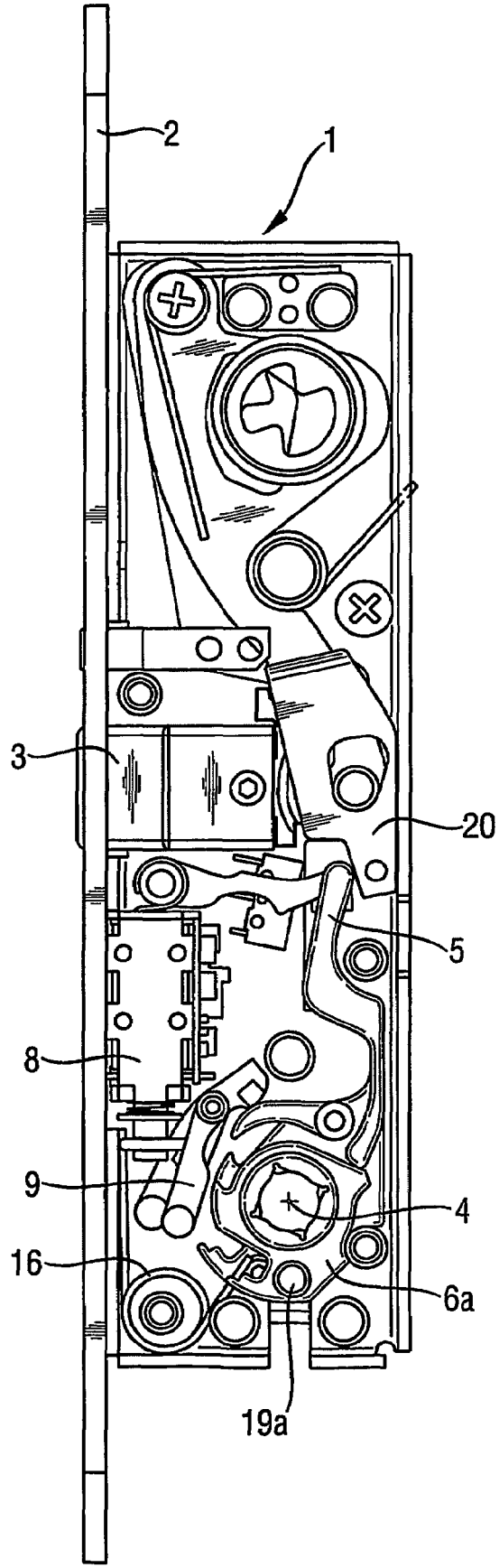
Figure 8:
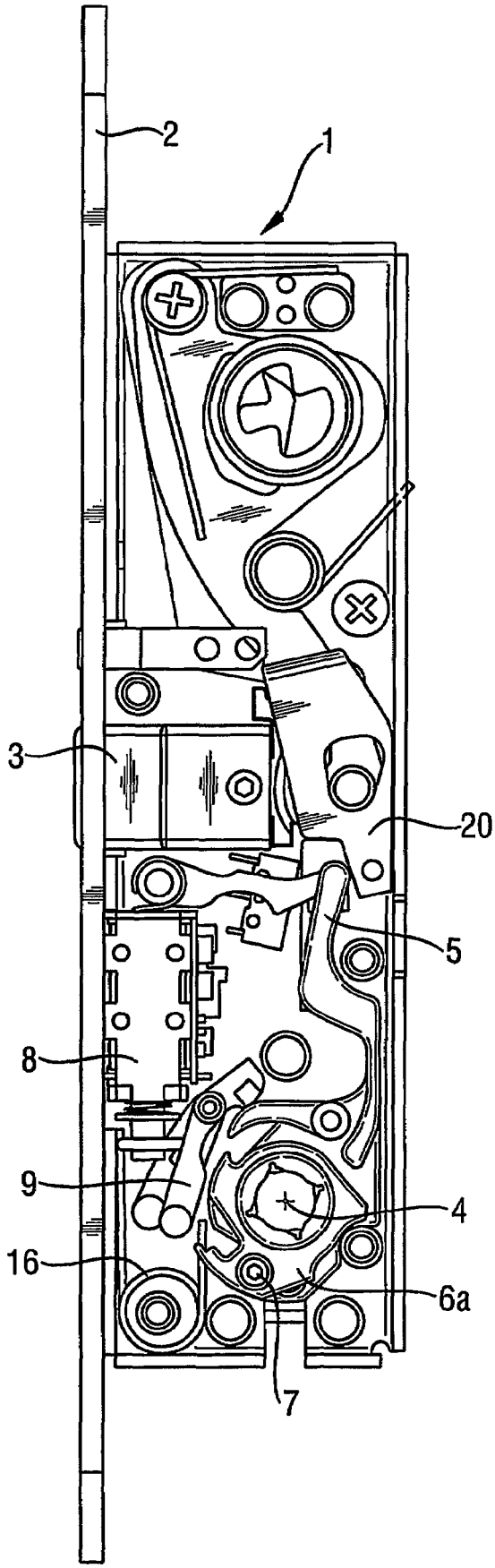
Figure 9:
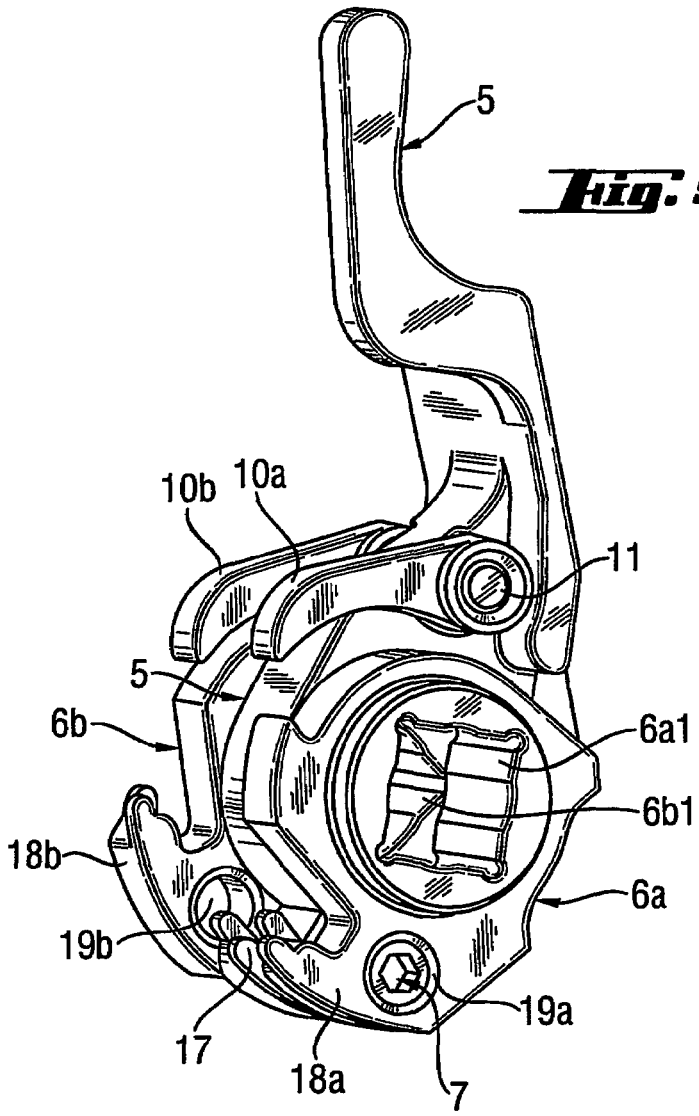
Figure 10:
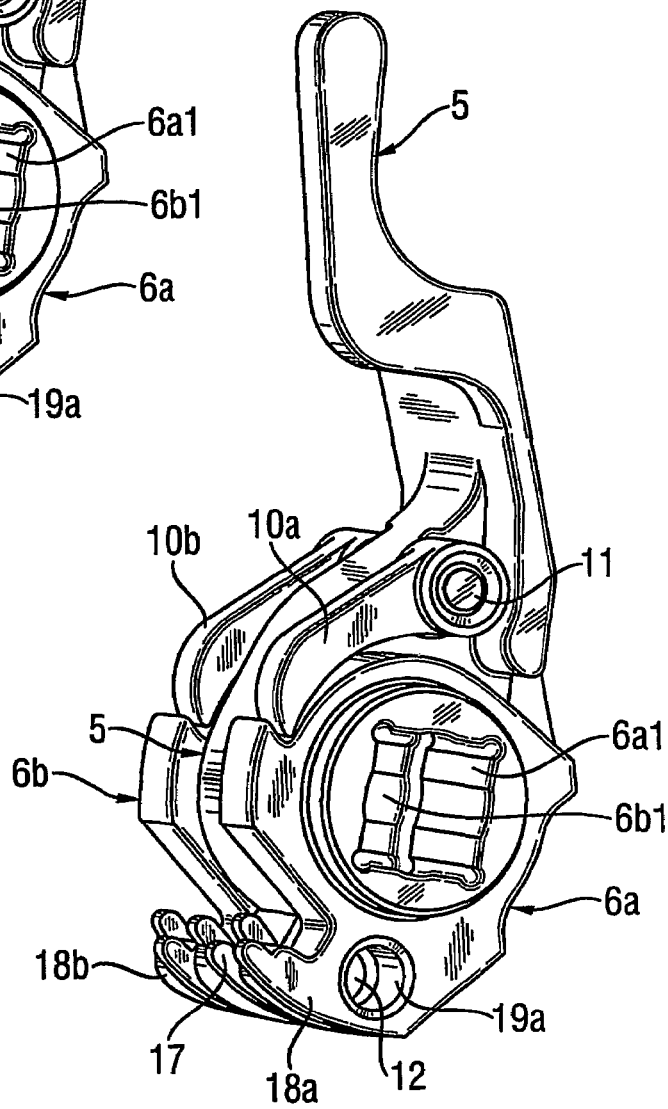

In the following the invention is described by way of example with reference to the attached drawings, in which FIGS. 1-3 illustrate a door lock according to the invention showing a first embodiment of the follower unit in its various operating positions;

FIGS. 4-6 illustrate the embodiment of the follower unit according to FIGS. 1-3 enlarged in its various operating positions;

FIGS. 7 and 8 illustrate another door lock according to the invention showing a second embodiment of the follower unit in its various operating positions; and FIGS. 9 and 10 illustrate the embodiment of the follower unit according to FIGS. 7 and 8 enlarged in its various operating positions.

In the figures the reference number 1 indicates a lock casing of a door lock having a front plate 2, bolt 3 and an operation axis 4 provided with a turnable follower 5, which by means of a force transmission member 20 is arranged to move the bolt 3 from its locking position into its retracted position in the lock casing 1. The turning of the follower 5 is accomplished by an actuator (not shown) installed on the operating axis, for instance by means of a handle or a lock mechanism, whereby force transmission from the actuator to the follower 5 takes place from either side of the follower 5 by means of torsion units 6*a*, 6*b*, which are turnably secured thereto.

The door lock is further provided with a selecting member 7, preferably a screw, by means of which one of the torsion units 6*a* or 6*b* can be retained so that it is unturnable with respect to the follower 5, whereby force transmission from that particular side of the lock is constantly connected. Accordingly, the operation of the other torsion unit is then operable by means of a solenoid 8 so that a lever arrangement 9 turned by the solenoid 8 has an impact on a latch 10*a* or 10*b* acting as a coupling member and turnably pivoted on a stub shaft 11 arranged at the follower 5, which latch is selected to either connect or disconnect force transmission from the torsion unit to the follower 5. In order to accomplish force transmission the lever arrangement 9 presses the latch to its connecting position. The disconnection of force transmission may be provided for instance by providing the lever arrangement 9 with a magnet (not shown), which attracts the latch, as the solenoid 8 turns the lever arrangement 9 away from the operation axis 4. The basic operation of the arrangement is discussed also in the above-mentioned publication EP 1354112, whereto a reference is made in this respect.

In the situation shown in FIG. 1 the foremost torsion unit 6*a*, i.e. the one shown in the figure, is by means of the selecting member 7 interlocked with the follower 5, whereby force transmission is continuously connected on the front side of the lock, i.e. from the operation axis via the follower 5 over to the bolt 3. In this case the actuator is either a key-operated lock mechanism or a handle or the like. A suitable actuator on the backside of the lock is a handle or the like, the operation of which can be controlled by the solenoid 8 so that there is selective force transmission from the handle to the bolt 3. In the situation according to FIG. 2 the bolt is retracted into the lock casing by turning the follower 5.

In the assembly according to FIG. 3 the selecting member 7 is moved to the other side of the lock and accordingly, it retains the torsion unit 6*b* (not shown in FIGS. 1-3) on the backside of the lock. In this case the moving of the bolt 3 depends on the position of the coupling member 10*a* controlled by the solenoid 8. In FIG. 3 the coupling member 10*a* is in its non-connecting position, whereby the bolt 3 cannot be moved from the lock side shown in the figure.

FIGS. 4-6 reveal the structure and cooperation of the follower 5 and the torsion units 6*a* and 6*b* in more detail. Here, two torsion units 6*a* and 6*b* are turnably adapted onto the respective sides of the follower 5. Since the torsion units have an identical structure and only one torsion unit 6*a* is clearly seen in figures, the structure of the torsion units is discussed in the following by referring mainly to said torsion unit 6*a* shown in the figures. The torsion unit has a spindle opening 6*a*1 for an actuator (not shown) to be installed on the operation axis 4. The torsion units are shaped and arranged in conjunction with the follower so that no direct force transmission from the operation axis 4 to the follower 5 exists.

The follower 5 is equipped with a stub shaft 11, onto which the latches 10*a* and 10*b* acting as coupling members are turnably secured, and with a threaded opening 12 in which the selecting member 7 is installed on the side of one of the torsion units in order to retain that particular torsion unit so that it is unturnable with respect to the follower. For this purpose the torsion unit 6*a* (6*b*) is provided with a recess 13*a* (13*b*), into which the expanded head 7*a* of the selecting member 7 can be placed. The follower 5 has a guiding member 14*a* (14*b*) extending to said recess 13*a* (13*b*) and being provided with a guiding surface 14*a*1 (14*b*1). When the selecting member 7 is in its locking position, it cooperates with both the recess 13*a* (13*b*) and the guiding surface 14*a*1 (14*b*1). The guiding member 14*a* (14*b*) is also in cooperation by its guiding surface 14*a*2 (14*b*2) with the protrusion 15*a* (15*b*) of the torsion unit. As shown in FIGS. 1-3 the protrusion 15*a* (15*b*) is affected by a spring arrangement 16, which aims at keeping the handle, which installed on the operation axis, in horizontal position.

According to FIG. 4 the torsion unit 6*a* is by means of the selecting member 7 fixedly connected to the follower 5, and similarly in FIG. 5, the backmost torsion unit 6*b* is fixedly connected to the follower 5. In the latter case the foremost torsion unit 6*a* in the figure is free to turn and there is no force transmission from the operation axis 4 to the follower 5, as the coupling member 10*a* is not in its connecting position.

FIGS. 7 and 8 show another door lock utilising the second embodiment of the follower unit, the structure of which is shown in more detail in FIGS. 9 and 10. The basic operation is similar to the one in FIGS. 1-6, but in this case the threaded opening 12 for the selecting member 7 is arranged in the protrusion 17 of the follower 5. Accordingly, the torsion units 6*a* and 6*b* are provided with respective protrusions 18*a* and 18*b* having openings 19*a* and 19*b*, respectively, for the selecting member 7. Also in this case the torsion unit to be exposed to continuous force transmission is selected by means of the selecting member by installing it through the opening in said torsion unit into the opening in the follower.

In FIG. 9 the selecting member 7 is installed into the opening 19*a* of the torsion unit 6*a*, whereby the torsion unit 6*a* provides continuous force transmission to the follower 5. Similarly, the backmost torsion unit 6*b* can be selectively connected to force transmission with the follower 5 by means of the coupling member 10*b*. According to FIG. 9 the coupling member 10*b* is not in its connecting position, whereby the torsion unit 6*b* is independently turnable with respect to the follower 5 and there is no force transmission. In FIG. 10 the selecting member 7 is moved from the foremost torsion unit 6*a* to the backmost torsion unit 6*b*, whereby it is similarly interconnected with the follower and there is continuous force transmission via the torsion unit 6*b* to the follower 5. Since the latch 10*a* in this case is also in its connecting position, there is also force transmission from the torsion unit 6*a* to the follower 5.

The invention is not limited to the above-described embodiments, but several other modifications are conceivable in the scope of the appended claims.

The invention claimed is:

1. A door lock having first and second opposite sides and comprising:

a bolt, a follower for moving the bolt, the follower having first and second opposite ends presented towards the first and second sides respectively of the lock and being formed with a threaded opening that is accessible from each end of the follower, first and second torsion units at the first and second sides respectively of the lock and turnably mounted on the first and second ends respectively of the follower, first and second movable coupling members, at the first and second sides respectively of the lock, which are selectively controllable to couple force transmission from the first and second torsion units respectively to the follower, a selecting member that can be installed in the lock on one of the first and second sides of the lock, by engaging the threaded opening of the follower from the first or second end of the follower, such that when the selecting member is installed on the first side the selecting member retains the first torsion unit against turning relative to the follower and permits the second torsion unit to turn relative to the follower, and when the selecting member is installed on the second side the selecting member retains the second torsion unit against turning relative to the follower and permits the first torsion unit to turn relative to the follower, and a means for selectively controlling the coupling member at the other of the first and second sides of the lock, whereby force transmission from the torsion unit at said other side of the lock to the follower is selectively connected, and wherein the first torsion unit is formed with a recess that is shaped to receive a part of the selecting member when the selecting member is installed in the lock on the first side of the lock, for preventing turning of the first torsion unit relative to the follower.

2. A door lock according to claim 1, wherein the selecting member is a screw having an enlarged head that is located in the recess when the selecting member is installed in the lock on the first side of the lock.

3. A door lock according to claim 1, wherein the first torsion unit has a peripheral surface region and the follower includes a guiding member that projects over the peripheral surface region of the first torsion unit.

4. A door lock according to claim 3, wherein the first torsion unit includes a protrusion that protrudes radially outward beyond said peripheral surface region and engages the guiding member when the first torsion unit turns in a first direction.

5. A door lock having first and second opposite sides and comprising:

a bolt, a follower for moving the bolt, the follower having first and second opposite ends presented towards the first and second sides respectively of the lock and being formed with a threaded opening that is accessible from each end of the follower, first and second torsion units at the first and second sides respectively of the lock and turnably mounted on the first and second ends respectively of the follower, first and second movable coupling members, at the first and second sides respectively of the lock, which are selectively controllable to couple force transmission from the first and second torsion units respectively to the follower, a selecting member that can be installed in the lock on one of the first and second sides of the lock, by engaging the threaded opening of the follower from the first or second end of the follower, such that when the selecting member is installed on the first side the selecting member retains the first torsion unit against turning relative to the follower and permits the second torsion unit to turn relative to the follower, and when the selecting member is installed on the second side the selecting member retains the second torsion unit against turning relative to the follower and permits the first torsion unit to turn relative to the follower, and a means for selectively controlling the coupling member at the other of the first and second sides of the lock, whereby force transmission from the torsion unit at said other side of the lock to the follower is selectively connected, and wherein the first coupling member is selectively controllable either to a first condition in which the first coupling member couples force transmission from the first torsion unit to the follower for rotating the follower in a first direction or to a second condition in which the first coupling member permits rotation of the first torsion unit in the first direction relative to the follower, and the first torsion unit and the follower include respective protrusions that prevent turning of the first torsion unit relative to the follower in a second direction, opposite the first direction, independently of whether the selecting member is installed on the first side of the lock.

6. A door lock having first and second opposite sides and comprising:

a bolt a follower for moving the bolt, the follower having first and second opposite ends presented towards the first and second sides respectively of the lock and being formed with a threaded opening that is accessible from each end of the follower, first and second torsion units at the first and second sides respectively of the lock and turnably mounted on the first and second ends respectively of the follower, first and second movable coupling members, at the first and second sides respectively of the lock, which are selectively controllable to couple force transmission from the first and second torsion units respectively to the follower, a selecting member that can be installed in the lock on one of the first and second sides of the lock, by engaging the threaded opening of the follower from the first or second end of the follower, such that when the selecting member is installed on the first side the selecting member retains the first torsion unit against turning relative to the follower and permits the second torsion unit to turn relative to the follower, and when the selecting member is installed on the second side the selecting member retains the second torsion unit against turning relative to the follower and permits the first torsion unit to turn relative to the follower, and a means for selectively controlling the coupling member at the other of the first and second sides of the lock, whereby force transmission from the torsion unit at said other side of the lock to the follower is selectively connected, and wherein the first and second torsion units and the follower are turnable about a common axis, the first torsion unit has first and second peripheral surface regions that are curved about said common axis and are peripherally spaced about the first torsion unit by a peripheral recess in the first torsion unit, the threaded opening of the follower is radially outward of the first and second peripheral surface regions of the first torsion unit, the selecting member has an enlarged head, and when the selecting member is installed on the first side of the lock, the head of the selecting member is at least partially received in said peripheral recess of the first torsion unit and thereby retains the first torsion unit against turning relative to the follower.

7. A door lock having first and second opposite sides and comprising:

a bolt a follower for moving the bolt, the follower having first and second opposite ends presented towards the first and second sides respectively of the lock and being formed with a threaded opening that is accessible from each end of the follower, first and second torsion units at the first and second sides respectively of the lock and turnably mounted on the first and second ends respectively of the follower, first and second movable coupling members, at the first and second sides respectively of the lock, which are selectively controllable to couple force transmission from the first and second torsion units respectively to the follower, whereby force transmission from either side of the lock can be employed for operating the follower, a selecting member installed in the lock on the first side of the lock and engaging the threaded opening of the follower from the first end of the follower, in a manner such that the selecting member prevents the first torsion unit from turning relative to the follower and permits the second torsion unit to turn relative to the follower, the selecting member being removable from the first side of the lock and installable on the second side of the lock in engagement with the threaded opening of the follower from the second end of the follower, in a manner such that the selecting member prevents the second torsion unit from turning relative to the follower and permits the first torsion unit to turn relative to the follower, and a means for selectively controlling the second coupling member, whereby force transmission from the second torsion unit to the follower is selectively connected, and wherein the first torsion unit is formed with a recess chat is shaped to receive a part of the selecting member, for preventing turning of the first torsion unit relative to the follower.

8. A door lock according to claim 7, wherein the selecting member is a screw having an enlarged head that is located in the recess.

9. A door lock according to claim 7, wherein the first torsion unit has a peripheral surface region and the follower includes a guiding member that projects over the peripheral surface region of the first torsion unit.

10. A door lock according to claim 9, wherein the first torsion unit includes a protrusion that protrudes radially outward beyond said peripheral surface region and engages the guiding member when the first torsion unit turns in a first direction.

11. A door lock having first and second opposite sides and comprising:

a bolt a follower for moving the bolt, the follower having first and second opposite ends presented towards the first and second sides respectively of the lock and being formed with a threaded opening that is accessible from each end of the follower, first and second torsion units at the first and second sides respectively of the lock and turnably mounted on the first and second ends respectively of the follower, first and second movable coupling members, at the first and second sides respectively of the lock, which are selectively controllable to couple force transmission from the first and second torsion units respectively to the follower, whereby force transmission from either side of the lock can be employed for operating the follower, a selecting member installed in the lock on the first side of the lock and engaging the threaded opening of the follower from the first end of the follower, in a manner such that the selecting member prevents the first torsion unit from turning relative to the follower and permits the second torsion unit to turn relative to the follower, the selecting member being removable from the first side of the lock and installable on the second side of the lock in engagement with the threaded opening of the follower from the second end of the follower, in a manner such that the selecting member prevents the second torsion unit from turning relative to the follower and permits the first torsion unit to turn relative to the follower, and a means for selectively controlling the second coupling member, whereby force transmission from the second torsion unit to the follower is selectively connected, and wherein the second coupling member is selectively controllable to a first condition in which the second coupling member couples force transmission from the second torsion unit to the follower for rotating the follower in a first direction or to a second condition in which the second coupling member permits rotation of the second torsion unit in the first direction relative to the follower, and the second torsion unit and the follower include respective protrusions that prevent turning of the second torsion unit relative to the follower in a second direction, opposite the first direction.

12. A door lock having first and second opposite sides and comprising:

a bolt, a follower for moving the bolt, the follower having first and second opposite ends presented towards the first and second sides respectively of the lock and being formed with a threaded opening that is accessible from each end of the follower, first and second torsion units at the first and second sides respectively of the lock and turnably mounted on the first and second ends respectively of the follower, first and second movable coupling members, at the first and second sides respectively of the lock, which are selectively controllable to couple force transmission from the first and second torsion units respectively to the follower, whereby force transmission from either side of the lock can be employed for operating the follower, a selecting member installed in the lock on the first side of the lock and engaging the threaded opening of the follower from the first end of the follower, in a manner such that the selecting member prevents the first torsion unit from turning relative to the follower and permits the second torsion unit to turn relative to the follower, the selecting member being removable from the first side of the lock and installable on the second side of the lock in engagement with the threaded opening of the follower from the second end of the follower, in a manner such that the selecting member prevents the second torsion unit from turning relative to the follower and permits the first torsion unit to turn relative to the follower, and a means for selectively controlling the second coupling member, whereby force transmission from the second torsion unit to the follower is selectively connected, and wherein the first and second torsion units and the follower are turnable about a common axis, the first torsion unit has first and second peripheral surface regions that are curved about said common axis and are peripherally spaced about the first torsion unit by a peripheral recess in the first torsion unit, the threaded opening of the follower is radially outward of the first and second peripheral surface regions of the first torsion unit, the selecting member has an enlarged head, and the head of the selecting member is at least partially received in said peripheral recess of the first torsion unit and thereby retains the first torsion unit against turning relative to the follower.

* * * * *